US008820399B2

(12) United States Patent
Witte et al.

(10) Patent No.: US 8,820,399 B2
(45) Date of Patent: Sep. 2, 2014

(54) MODULAR COILED TUBING UNIT

(71) Applicant: Premier Coil Solutions, Houston, TX (US)

(72) Inventors: M. Brett Witte, Houston, TX (US); Do Seo Park, Houston, TX (US)

(73) Assignee: Premier Coil Solutions, Houston, TX (US)

( * ) Notice: Subject to any disclaimer, the term of this patent is extended or adjusted under 35 U.S.C. 154(b) by 0 days.

(21) Appl. No.: 13/962,767

(22) Filed: Aug. 8, 2013

(65) Prior Publication Data

US 2014/0076533 A1 Mar. 20, 2014

Related U.S. Application Data

(60) Provisional application No. 61/703,672, filed on Sep. 20, 2012.

(51) Int. Cl.
*E21B 19/22* (2006.01)
*E21B 19/00* (2006.01)

(52) U.S. Cl.
CPC ..... *E21B 19/008* (2013.01); *E21B 19/00* (2013.01)
USPC ..... 166/77.2

(58) Field of Classification Search
USPC ..... 166/77.2, 379, 381; 242/399
See application file for complete search history.

(56) References Cited

U.S. PATENT DOCUMENTS 7,810,574 B2 * 10/2010 Stukey et al. ..... 166/384

OTHER PUBLICATIONS

PCT/US2013/060984 filed Sep. 20, 2013, International Search Report dated Nov. 26, 2013, 5 pages.

* cited by examiner

*Primary Examiner* — David Andrews
(74) *Attorney, Agent, or Firm* — Lloyd L. Davis; Andrews Kurth LLP

(57) ABSTRACT

A coiled tubing unit includes a coiled tubing reel skid comprising a load supporting skid frame having a plurality of guide post sleeves and a reel skid landing platform comprising a plurality of guide posts that mate with the plurality of guide post sleeves, wherein mating of the guide posts with the guide post sleeves is configurable so that the coiled tubing reel skid is disposable at multiple positions on the landing platform. The coiled tubing unit is configurable for many different weight distribution requirements.

20 Claims, 6 Drawing Sheets

MODULAR COILED TUBING UNIT

CROSS REFERENCE TO RELATED APPLICATIONS

This application claims priority from U.S. Provisional Patent Application No. 61/703,672 filed on Sep. 20, 2012, and which is incorporated herein by reference in its entirety.

TECHNICAL FIELD

This disclosure relates in general to a coiled tubing unit having modular components to facilitate configurable load distribution.

BACKGROUND

In the oil and gas industries, coiled tubing refers to metal piping, normally one inch to almost four inches in diameter, used for interventions in oil and gas wells and sometimes as production tubing in depleted gas wells, which comes spooled on a large reel. The oil and gas industry continues to move towards longer tubing, larger outside diameter tubing and tubing with creased wall thickness causing ever increasing weight demands for coiled tubing units. In addition, roadways in different states and different localities often have different weight distribution requirements between axles. What is needed is a coiled tubing unit that may be configured for many different weight distribution requirements.

SUMMARY

In one aspect, one or more embodiments disclosed herein relate to a coiled tubing unit comprising a coiled tubing reel skid comprising a load supporting skid frame having a plurality of guide post sleeves and a reel skid landing platform comprising a plurality of guide posts that mate with the plurality of guide post sleeves, wherein mating of the guide posts with the guide post sleeves is configurable so that the coiled tubing reel skid is disposable at multiple positions on the landing platform.

In other aspects, embodiments disclosed herein relate to a coiled tubing unit comprising a coiled tubing reel skid comprising a load supporting skid frame having a plurality of guide posts and a reel skid landing platform comprising a plurality of guide post capture holes that receive the plurality of guide posts, wherein mating of the guide posts with the guide post capture holes is configurable so that the coiled tubing reel skid is disposable at multiple positions on the landing platform.

In yet other aspects, embodiments disclosed herein relate to a method for varying load configurations on a coiled tubing unit, the method comprising positioning a coiled tubing reel skid at a first location on a reel skid landing platform and providing a first load configuration, and repositioning the coiled tubing reel skid at a second location on the reel skid landing platform and providing a different load configuration.

BRIEF DESCRIPTION OF THE DRAWINGS

The invention is illustrated in the accompanying drawings wherein.

DETAILED DESCRIPTION

Figure 1:
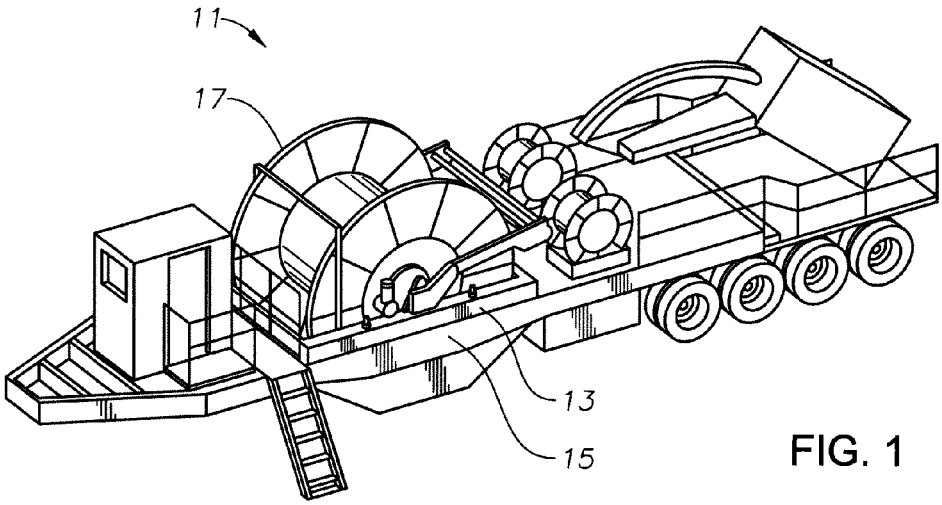
FIG. 1 illustrates a perspective view of an embodiment of a coiled tubing unit.

The aspects, features, and advantages of the invention mentioned above are described in more detail by reference to the drawings, wherein like reference numerals represent like elements.

A coiled tubing unit having modular components to facilitate configurable load and weight distribution is disclosed. The coiled tubing unit may comprise a complete set of equipment necessary to perform standard continuous-length tubing operations in the field. For example, the coiled tubing unit may comprise a reel for storage and transport of coiled tubing, an injector head to provide surface drive force to run and retrieve coiled tubing, a control cabin from which an equipment operator may monitor and control the coiled tubing, and a power pack to generate hydraulic and pneumatic power required to operate the coiled tubing unit. The coiled tubing units may further comprise other equipment for continuous-length or coiled tubing operations in the field.

Moreover, in certain embodiments the coiled tubing unit may comprise onshore coiled tubing units such as a truck mounted coiled tubing unit or larger trailer mounted coiled tubing units. Still further, in other embodiments the coiled tubing unit may comprise offshore coiled tubing units such as those mounted on a lift boat, barge, offshore platform or any other offshore structure.

The coiled tubing unit comprises a coiled tubing reel skid on which a coiled tubing reel is mounted, and a coiled tubing reel skid landing platform. The coiled tubing reel skid may be disposable on the coiled tubing reel skid landing platform at multiple positions, which changes the load or weight distribution across the coiled tubing unit at each position. For example, the reel skid disposed on the reel skid landing platform at a first location will yield a first weight distribution across the coiled tubing unit. Likewise, the reel skid disposed on the reel skid landing platform at a second location will yield a second weight distribution across the coiled tubing unit. The reel skid may be disposed at many more positions on the reel skid landing platform as well.

The coiled tubing reel skid landing platform comprises one or more guide posts positioned at one or more locations along a length of the landing platform. Additionally, the guide posts are moveable along each landing platform arranged on respective sections of a set of load bearing truss sections. For example, the guide posts may be positioned in various configurations along a set of guide post base boundary lines. The guide posts may be cylindrical, square, rectangular, polygonal or other shapes. Once in position, the guide posts may be secured to the reel skid landing platform with a set of guide post base bolts that attach through the bases of the guide posts and into the pre-drilled holes in the landing platform. The various guide post positions allow the weight of the reel skid to be shifted between wheel axle groups of the unit when attached to a truck or between the rear wheel axle group and the stationary support section. Additionally, guide posts may be moved closer together or farther apart to accommodate different reel skid sleeve configurations or different sized reel skids. In an alternate embodiment multiple sets of guide posts may be installed on an individual unit to provide greater stability for a given load.

The coiled tubing reel skid comprises one or more guide post sleeves corresponding with the one or more reel skid guide posts. The guide post sleeves may have cross-sections such as cylindrical, square, rectangular, polygonal or other shapes. The guide post sleeves are configured to accept the reel skid guide posts as the reel skid is lowered onto the unit. The guide post sleeves comprise guide post collars and extend partially through the skid frame. The guide post sleeves may further comprise a box-shaped cavity for the guide post bases. In an alternate embodiment the guide post sleeves may extend completely through the skid frame.

In yet other embodiments, multiple guide post sleeves may be used. Multiple guide post sleeve sets may allow for multiple skid placement options on the skid landing platform without the need to move the guide posts between positions. The reel skid can be decoupled from the guide posts by removing any retaining pins, at that point the reel skid can be lifted with a crane. Once lifted the crane can move the reel skid or the unit can be placed into a different position such that when landed again, a different set of guide post sleeves align with the guide posts. By shifting the reel skid, which represents the majority of the load on the unit, alternate load configurations can be achieved. For example, it may be preferential with a certain load to place more weight on the rear axle group or on the forward axle group of the truck hauling the unit. Additionally, when the truck is detached from the unit it may be advantageous to have a certain load distribution on the unit for the type of soil or pavement the unit will rest on during installation of the coiled tubing into a well site. In another embodiment multiple guide post sets can be installed for use with multiple guide post sleeve sets. This may be useful for heavier reel skids, imbalanced reel skids or for more unstable transport paths where greater stability is needed for a given load.

Once the skid is lowered and installed on the skid landing platform, a set of retaining pins can be installed through a set of pin holes that extend through the guide posts. In alternate embodiments, the pin holes can extend through a set of guide post collars or a set of skid frame guide post sleeve sections. In these embodiments the pin holes also extend through the guide posts themselves, providing an opening, through which the retaining pins can be placed. The retaining pins can be threaded and screw in or have a smooth surface and slide in through the pin holes. Retaining pin clips can be installed to retain the retaining pins in the retaining pin holes. A set of reel skid landing pads are attached to the bottom portion of the skid frame and provide a contact surface between skid frame and the landing platform. The set of landing pads raise the skid frame off of the landing platform and provide a gap for the rectangular bases of the guide posts. The landing pads also provide a frictional surface to help keep the skid in a stationary position during transport and during installation.

FIG. 1 illustrates a coiled tubing unit 11 having modular components to facilitate configurable load distribution in accordance with one or more embodiments. The unit 11 supports the coiled tubing reel skid 13 on the coiled tubing reel skid landing platform 15. At least one string of coiled tubing (not shown) will sit around the coiled tubing reel 17 and represent the bulk of the load to be supported by the unit 11. The coiled tubing unit 11 facilitates transportation of the reel 17 and the other well servicing and production components to the well site. Once at the well site, the unit 11 is configured for installation and the string of coiled tubing is fed into the well directly off the unit 11.

Figure 2:
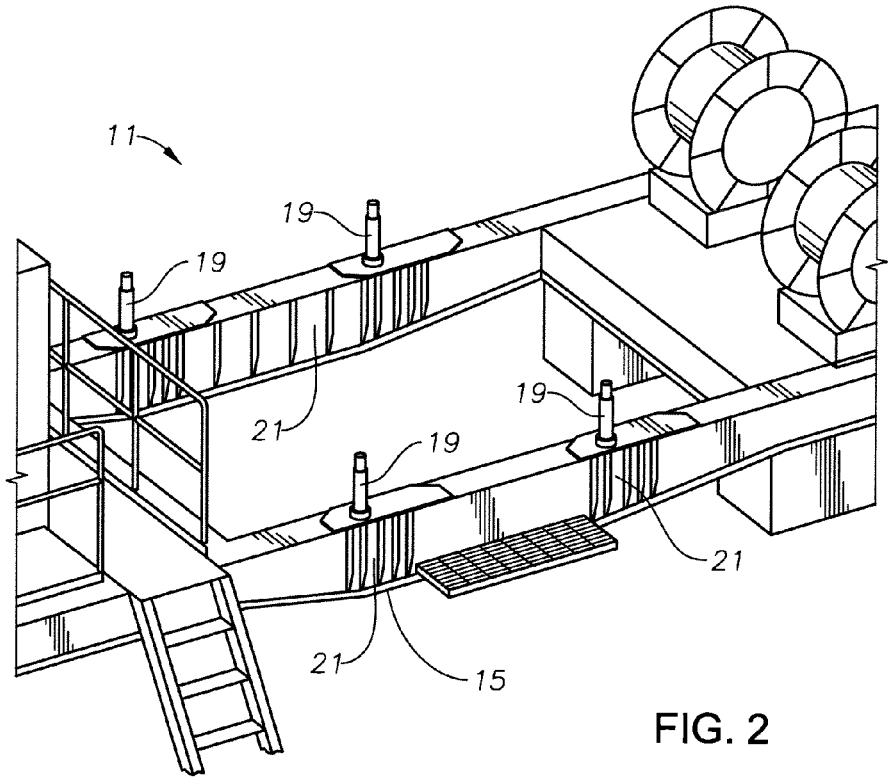
FIG. 2 illustrates a perspective view of an embodiment of a coiled tubing reel skid landing platform of the coiled tubing unit of FIG. 1.

FIG. 2 shows an enlarged view of the coiled tubing reel skid landing platform 15 of the coiled tubing unit 11 with the coiled tubing reel skid (as shown in FIG. 1) removed. Configurable reel skid guide posts 19 provide support for the coiled tubing reel skid 13. The weight of the coiled tubing reel skid 13 can vary based on tubing length, tubing outside diameter, tubing wall thickness, tubing material, and variation in the structure of the tubing reel skid 13. The oil & gas industry continues to move towards longer tubing, larger outside diameter tubing and tubing with increased wall thickness causing ever increasing weight demands for coiled tubing units. The reel skid guide posts 19 bear load at rest and provide enough lateral support for load shifts during transportation and installation activities. Additionally, the reel skid guide posts 19 are moveable along each respective section of a set of load bearing truss sections 21, the movement of the guide posts is discussed in further detail in the descriptions of FIGS. 7-8 below. Each truss section 21 supports the compressive and tensile forces caused by the reel skid 13 resting on the reel skid landing platform 15.

Figure 3:
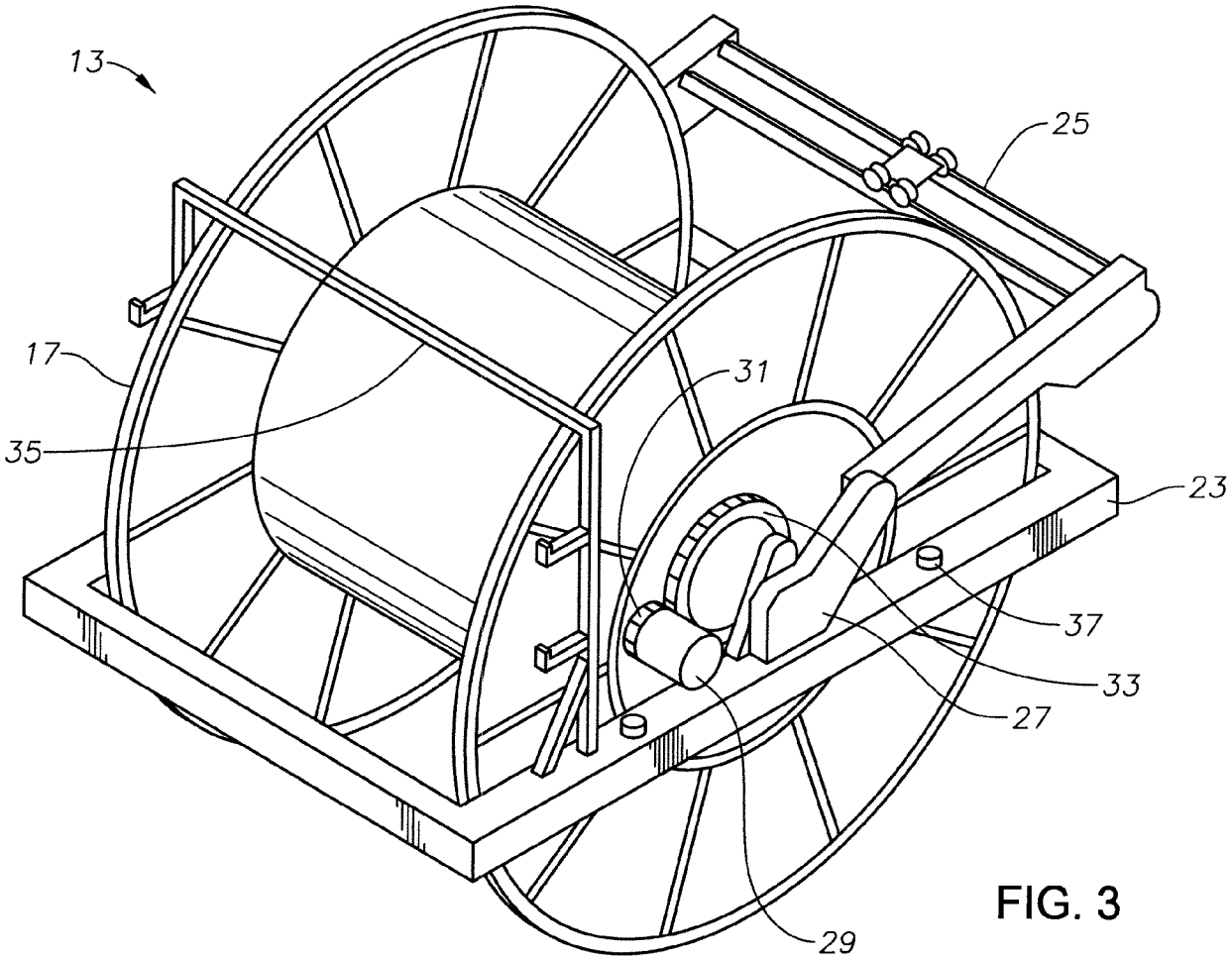
FIG. 3 illustrates a perspective view of an embodiment of a coiled tubing reel skid of the coiled tubing unit of FIG. 1.

FIG. 3 further illustrates the coiled tubing reel skid 13 in a view separate from the coiled tubing unit 11. The coiled tubing reel skid 13 supports the coiled tubing reel 17 and at least one string of coiled tubing (not shown) sitting around the reel 17. The load supporting skid frame 23 comprises four beams connected in a rectangular shape and positioned to completely surround the reel 17. The load supporting skid frame 23 provides support for the coiled tubing, the reel 17, and the various components of the reel skid 13 and distributes the load on the coiled tubing reel skid landing platform 15 (as shown in FIG. 1). The components of the reel skid 13 can be configured to be fixed or removable and may be selectively included or not included depending on a particular customer's needs. The reel skid 13 can have a levelwind 25 which serves to guide tubing as it comes off of the reel 17 during installation or holds tubing in anticipation of installation. In this embodiment, the levelwind 25 has a tubing guidance structure that can pivot into various positions along the outer edge of the reel 17 and connects to the skid 13 at a set of connection hubs 27. The axle of the reel 17 is attached to the connection hubs 27 which mount on a beam of the load supporting skid frame 23. In some embodiments a motor 29 can be mounted to the skid frame 23. The motor may be hydraulic or electric and has a motor gear 31 connected to a chain (not shown) that drives a reel gear 33 to turn and tension the reel 17. In an alternate embodiment the motor 29 can directly drive the reel 17 without the use of a chain. The connection hubs 27 have removable bolts that allow the reel 17 to disconnect from the skid frame 23 for spooling of the reel 17 or servicing of the reel 17 or the skid frame 23. Additionally, the connection hub 27 can have mounting brackets for the connection of a spreader bar 35. The spreader bar 35 provides structure to connect a crane to the reel skid 13 which can lift the skid 13 on and off the unit 11. The skid 13 can be removed for maintenance, to re-spool an empty reel, to replace one reel with another reel, to reconfigure the skid landing platform 15, or for various other reasons. Additionally, the connection hubs 27 can be disconnected from the skid 13 and the reel 17 can be lifted off without the skid 13. The skid frame 23 has a set of guide post sleeves 37 which accept the reel skid guide posts 19 (as shown in FIGS. 1 and 2) as the reel skid 13 is lowered onto the unit 11. The guide post sleeves may be cylindrical, square, rectangle, polygonal or other shapes that correspond with the guide posts.

Figure 4:
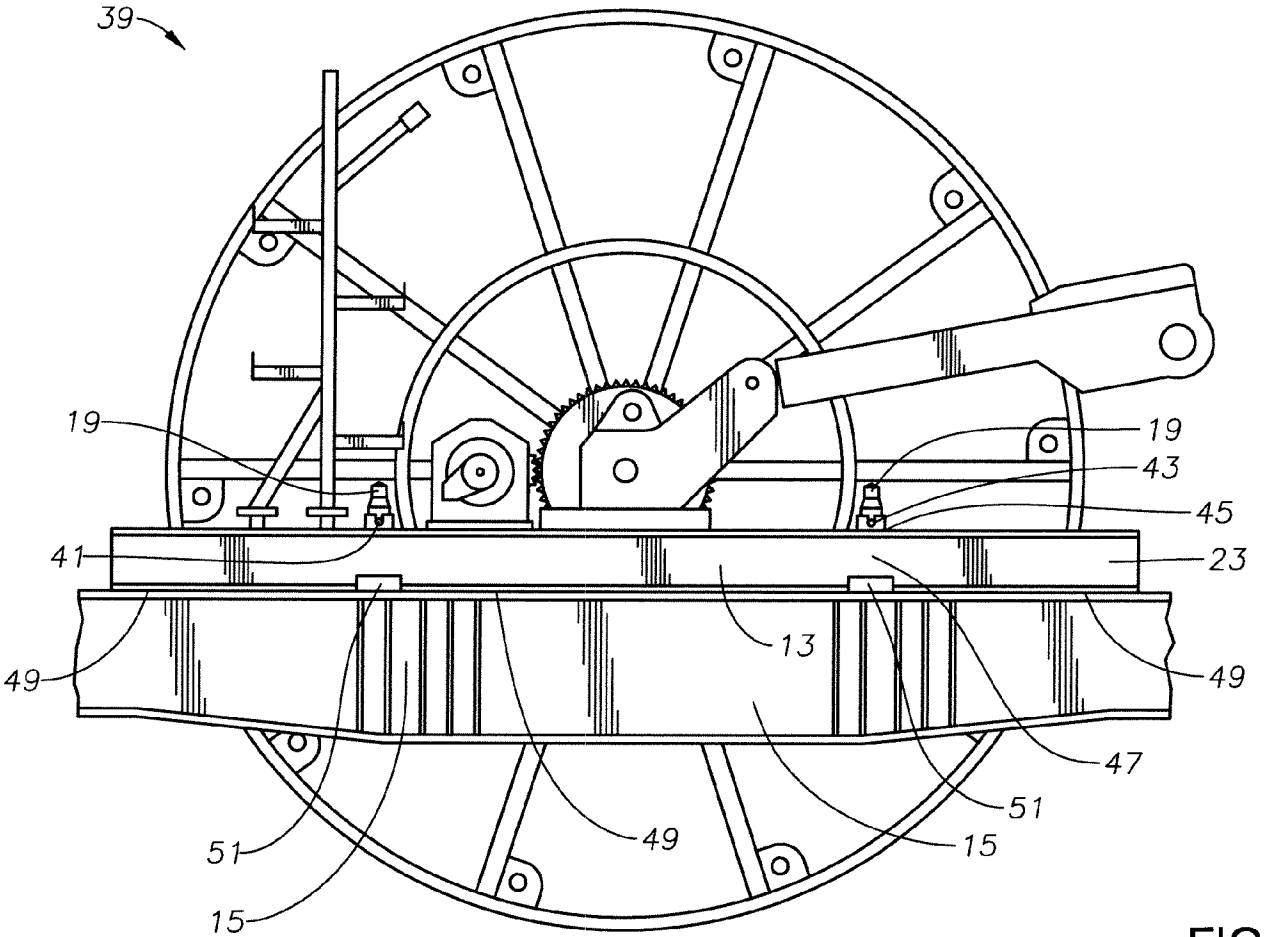
FIG. 4 illustrates a side elevation view of an embodiment of a coiled tubing reel skid section of the coiled tubing unit of FIG. 1.

FIG. 4 illustrates the coiled tubing reel skid section 39 of the coiled tubing unit 11. Once the skid 13 is lowered and installed on the skid landing platform 15, a set of retaining pins 41 can be installed through a set of pin holes 43 that extend through the guide posts 19. In alternate embodiments, the pin holes 43 can extend through a set of guide post collars 45 or a set of skid frame guide post sleeve sections 47 which are further described in FIG. 5 below. In these embodiments the pin holes 43 also extend through the guide posts 19 themselves, providing an opening, through which the retaining pins 41 can be placed. The retaining pins 41 can be threaded and screw in or have a smooth surface and slide in through the pin holes 43. Retaining pin clips (not shown) can be installed to retain the retaining pins 41 in the retaining pin holes 43. A set of reel skid landing pads 49 are attached to the bottom portion of the skid frame 23 and provide a contact surface between skid frame 23 and the landing platform 15. The set of landing pads 49 raise the skid frame 23 off of the landing platform 15 and provide a gap for the rectangular bases 51 of the guide posts (shown in FIGS. 7-8 and described in further detail below). The landing pads 49 also provide a frictional surface to help keep the skid 13 in a stationary position during transport and during installation.

Figure 5:
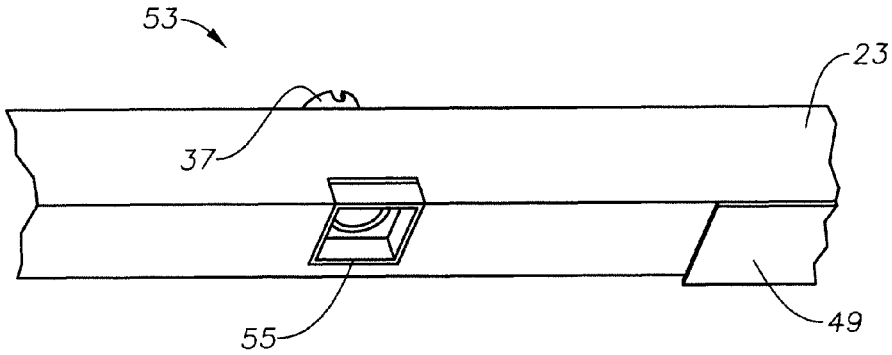
FIG. 5 illustrates a perspective view of an embodiment of a reel skid guide post sleeve section of the coiled tubing reel skid of FIG. 2.

FIG. 5 shows an enlarged view of the reel skid guide post sleeve section 53. The guide post sleeves 37 begin with the guide post collars 45 and extend partially through the skid frame 23. In this embodiment, a set of box shaped bottom guide post base sleeves 55 provides a cavity for the guide post bases 51 (shown in FIGS. 7-8 and described in further detail below). In an alternate embodiment the guide post sleeves 37 may extend completely through the skid frame 23. This view further shows part of the landing pad 49 which can vary in height for various guide post 19 sizes and configurations. In alternate embodiments various guide post sleeve shapes and corresponding guide post shapes may be used.

Figure 6:
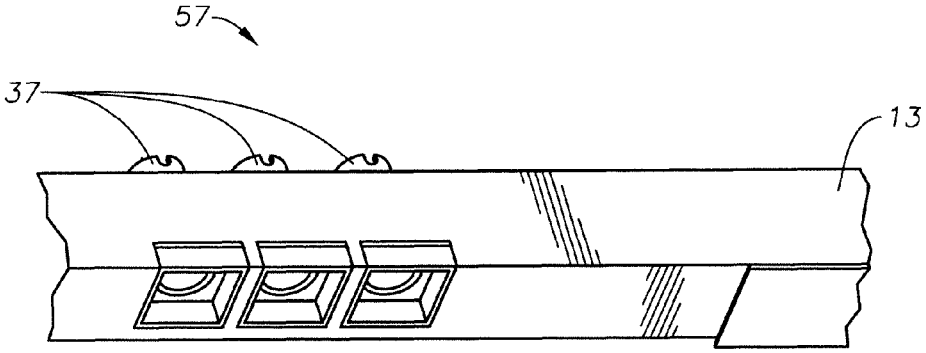
FIG. 6 illustrates a perspective view of an embodiments of an alternate reel skid guide post sleeve section of the coiled tubing reel skid.

FIG. 6 illustrates an embodiment of the alternate reel skid guide post sleeve section 57. In this embodiment multiple guide post sleeve sets 37 allow for multiple skid 13 placement options on the skid landing platform 15 without the need to move the guide posts 19 between positions. This embodiment allows for versatile weight distribution management of the unit 11. The reel skid 13 can be decoupled from the guide posts 19 (as shown in previous figures) by removing any retaining pins 41, at that point the reel skid 13 can be lifted with a crane. Once lifted the crane can move the reel skid 13 or the unit can be placed into a different position such that when landed again, a different set of guide post sleeves 37 align with the guide posts 19. By shifting the reel skid 13, which represents the majority of the load on the unit 11, alternate load configurations can be achieved. For example, it may be preferential with a certain load to place more weight on the rear axle group or on the forward axle group of the truck hauling the unit. Additionally, when the truck is detached from the unit 11 it may be advantageous to have a certain load distribution on the unit 11 for the type of soil or pavement the unit 11 will rest on during installation of the coiled tubing into a well site. In another embodiment multiple guide post sets can be installed for use with multiple guide post sleeve sets. This may be useful for heavier reel skids, imbalanced reel skids or for more unstable transport paths where greater stability is needed for a given load.

Figure 7:
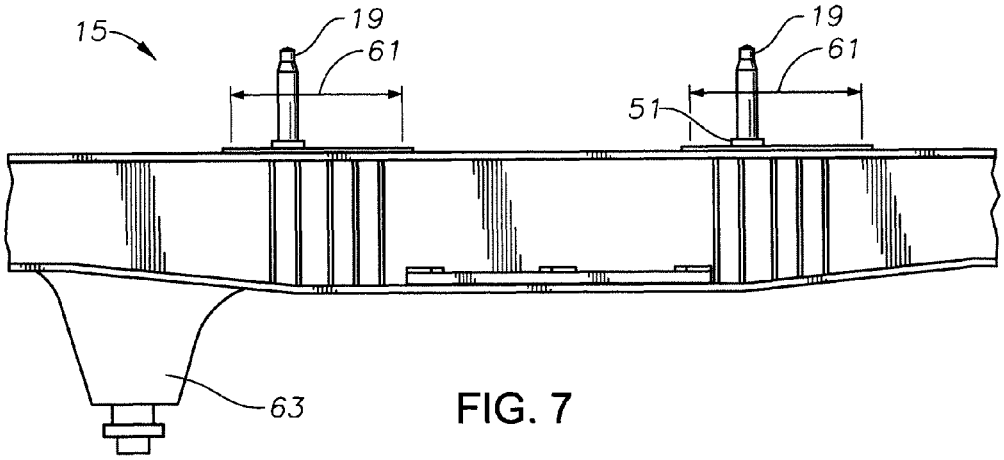
FIG. 7 illustrates a left-side elevation view of an embodiment of the coiled tubing unit landing platform of the unit of FIG. 1.

FIG. 7 shows an enlarged side view of the coiled tubing unit landing platform 15. The guide posts 19 can be positioned in various configurations along a set of guide post base boundary lines 61. Once in position, the guide posts 19 are secured to the landing platform 15 with a set of guide post base bolts (shown in FIG. 8 and described below) that attach through the bases 51 of the guide posts and into the pre-drilled holes in the landing platform 15 (also shown in FIG. 8 and described below). The various guide post positions allow the weight of the reel skid 13 to be shifted between wheel axle groups of the unit 11 when attached to a truck or between the rear wheel axle group (shown in FIG. 1) and the stationary support section 63. Roadways in different states and different localities often have different weight distribution requirements between axles. A modular system such as this can allow one unit to be configured for many different weight distribution requirements. Additionally, when the unit 11 is at the installation site and configured for installation it can be advantageous to have a particular weight distribution in place, for example, to accommodate variation in ground elevation, soil type, road type, or other conditions particular to a well site location. Additionally, guide posts 19 may be moved closer together or further apart to accommodate different reel skid 13 sleeve configurations or different sized reel skids. In an alternate embodiment multiple sets of guide posts 19 can be installed on an individual unit to provide greater stability for a given load. In this embodiment a reel skid frame with multiple guide post sleeves 37 may be used as illustrated in FIG. 6. The load of this embodiment can still be shifted forward and rearward on a given unit depending on the particular set up of the unit and the placement of the guide post sets 19 and guide post sleeve sets 37.

In one embodiment, and as illustrated in FIGS. 1, 2, 4, 5 and 7, a set of four guide post sleeves 37 may be built into the load supporting skid frame 23, two sleeves 37 in each of the exterior facing side beams of the skid 13. In this embodiment the load is shifted forward and rearward on a given unit primarily by repositioning guide posts 19. In other embodiments guide posts 19 can be installed in a fixed position on the unit 11 and multiple sets of guide post sleeves 37, as illustrated in FIG. 6, can be used to shift the load. Additionally, and as mentioned above, other configurations can be implemented where multiple guide post sets 19 and multiple guide post sleeves 37 are in use at the same time. This can be useful for exceptionally heavy coiled tubing loads or when greater stability is required. In another embodiment, as few as two guide posts 19 can be installed on landing pad 15, preferably diagonally opposite from each other in relation to skid 13.

Figure 8:
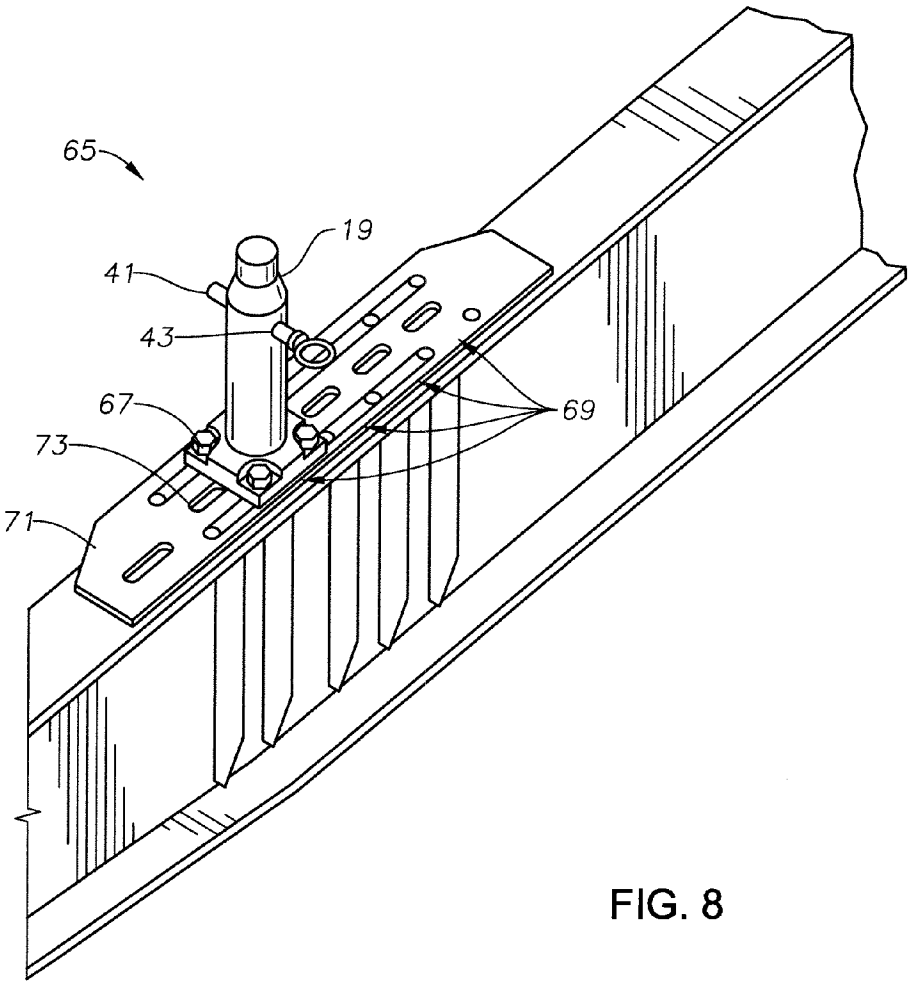
FIG. 8 illustrates a perspective view of an embodiment of an individual modular guide post section of the landing platform of the unit of FIG. 1.

FIG. 8 shows an enlarged view of one of the modular guide post sections 65. With the other guide posts 19 installed in similar positions in each one of the modular guide post sections 65, the unit is configured to bias the load of the skid 13 (shown in FIGS. 1, 3, and 4-6) and the coiled tubing held by the skid 13 towards the rear axle group of the unit 11. The guide post base bolts 67 attach the guide post 19 to the modular guide post section 65. Each guide post 19 may be removed and reconfigured on any of a number of guide post positions 69. A set of guide post mounting plates 71 connect to the landing platform 15 and provide additional reinforcement for base bolts 67. Mounting plate slots 73 provide connection points through which to weld the mounting plate 71 to the landing platform 15. Alternatively, multiple guide posts 19 may be installed for use with the alternate embodiment skid having multiple guide post sleeves 37 as illustrated in FIG. 6.

Figure 9:
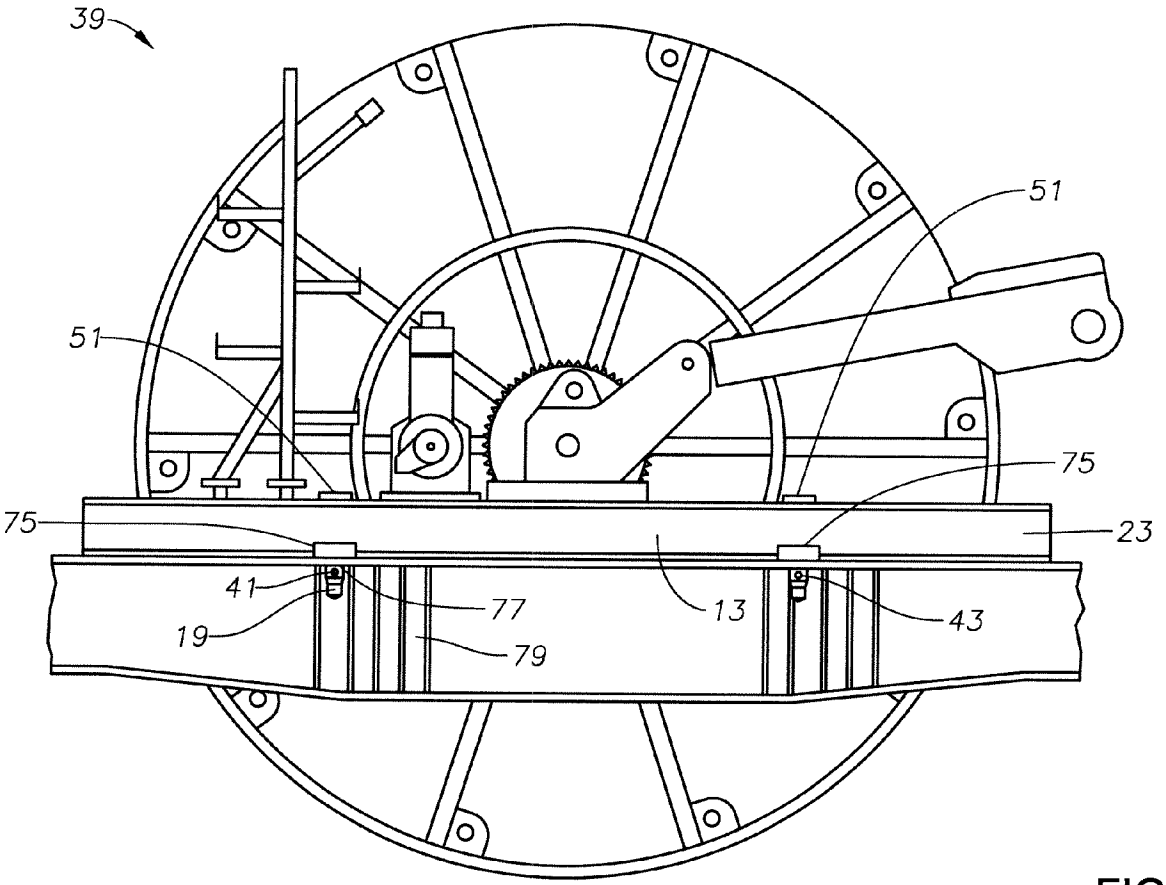
FIG. 9 illustrates a side elevation view of an embodiment of the coiled tubing reel skid section of the coiled tubing unit of FIG. 1.

FIG. 9 illustrates an alternate embodiment of the coiled tubing reel skid section 39 of the coiled tubing unit 11. In this embodiment, the guide posts 19 are inverted, placed through a set of inverted skid sleeves 75 and the guide post bases 51 are attached to the skid 13. The landing platform 15 of this embodiment has one or more sets of guide post capture holes 77, thereby allowing for multiple skid 13 positions similar to the above described embodiments. Once the skid 13 is lowered and installed on the skid landing platform 15, a set of retaining pins 41 can be installed through a set of pin holes 43 that extend through the guide posts 19. In an embodiment, multiple sets of inverted guide post sleeves 75 can additionally allow for even greater maneuverability of the skid 13. In another embodiment the skid frame 23 may sit in a lower position with respect to landing platform 15. For this embodiment, the skid frame 23 can be positioned inside landing platform frame 79, partially hanging over the landing platform frame 79 or in another configuration that would allow a set of guide posts 19 to extend through the landing platform and the skid 13, thereby securing the skid 13 for transport. In this embodiment, the landing platform frame 79 and the skid frame 23 can have multiple guide post 19 capture cavities or sleeves to allow the load to be shifted on the trailer in a manner similar to the other embodiments described. In this embodiment the guide post 19 may alternatively only extend through one of either the landing platform frame 79 or the skid frame 23 and then attach, by bolts or other methods, to the frame the guide post did not extend through.

Additionally, the modular guide post system, the modular sleeve system, or both systems in combination, can be implemented on both a trailered unit and on an offshore shippable unit. The weight distribution on the offshore shippable unit affecting the load distribution while onshore, during onshore transportation, during offshore transportation and at the offshore installation site.

The claimed subject matter is not to be limited in scope by the specific embodiments described herein. Indeed, various modifications of one or more embodiments disclosed herein in addition to those described herein will become apparent to those skilled in the art from the foregoing description. Such modifications are intended to fall within the scope of the appended claims.

As used in this specification and the following claims, the terms "comprise" (as well as forms, derivatives, or variations thereof, such as "comprising" and "comprises") and "include" (as well as forms, derivatives, or variations thereof, such as "including" and "includes") are inclusive (i.e., open-ended) and do not exclude additional elements or steps. Accordingly, these terms are intended to not only cover the recited element(s) or step(s), but may also include other elements or steps not expressly recited. Furthermore, as used herein, the use of the terms "a" or "an" when used in conjunction with an element may mean "one," but it is also consistent with the meaning of "one or more," "at least one," and "one or more than one." Therefore, an element preceded by "a" or "an" does not, without more constraints, preclude the existence of additional identical elements.

What is claimed:

1. A coiled tubing transport unit comprising:

a coiled tubing reel skid comprising a load supporting skid frame having one or more guide post sleeves; and a reel skid landing platform comprising:

a plurality of guide post base connection points at multiple locations along a length of the landing platform; and one or more guide posts attachable at any of the plurality of guide post base connection points and configured to mate with the one or more guide post sleeves.

2. The coiled tubing unit of claim 1, further comprising guide post mounting plates attached to the landing platform at the plurality of guide post base connection points.

3. The coiled tubing unit of claim 1, further comprising load bearing truss sections positioned substantially beneath the plurality of guide post base connection points to bear the load of the coiled tubing reel skid.

4. The coiled tubing unit of claim 1, wherein the guide posts each comprise a base portion attachable to the landing platform.

5. The coiled tubing unit of claim 4, wherein base portions of the guide posts are attached to the landing platform with bolts.

6. The coiled tubing unit of claim 1, wherein the guide posts are fixed and configured to receive different guide post sleeves to facilitate positioning the reel skid at multiple locations on the landing platform.

7. The coiled tubing unit of claim 1, further comprising guide post retaining pins to hold the coiled tubing reel skid in position during transport.

8. The coiled tubing unit of claim 1, wherein the guide post sleeves extend at least partially through the load supporting skid frame.

9. The coiled tubing unit of claim 1, further comprising one or more landing pads affixed to a bottom portion of the load supporting skid frame.

10. The coiled tubing unit of claim 1, further comprising a coiled tubing reel supported on the coiled tubing reel skid.

11. The coiled tubing unit of claim 1, further comprising one or more landing pads affixed to a bottom portion of the load supporting skid frame.

12. The coiled tubing unit of claim 1, further comprising a coiled tubing reel supported on the coiled tubing reel skid.

13. The coiled tubing transport of claim 1, wherein mating said one or more guide posts with said one or more guide post sleeves is configurable so that the load supporting skid frame is transportable at multiple locations along a length of said landing platform.

14. A coiled tubing unit comprising:

a coiled tubing reel skid comprising a load supporting skid frame having at least one downwardly extending guide post disposed along a length of said skid frame; and a reel skid landing platform having guide post capture holes disposed at multiple locations along a length said platform and configured to engage with the downwardly extending guide post;

wherein mating of the at least one guide post with the guide post capture holes is configurable so that the coiled tubing reel skid is disposable at multiple positions along a length of the landing platform.

15. The coiled tubing unit of claim 14, further comprising a plurality of guide post capture holes on the load supporting skid frame to facilitate positioning the reel skid at multiple locations on the landing platform.

16. The coiled tubing unit of claim 14, further comprising:

guide post sleeves that extend through the load supporting skid frame, wherein inverted guide posts are inserted into the guide post sleeves; and bolts attaching the plurality of guide posts to the load supporting skid frame.

17. The coiled tubing unit of claim 14, further comprising load bearing truss sections positioned beneath the plurality of guide post capture holes to bear the load of the coiled tubing reel skid.

18. The coiled tubing unit of claim 14, further comprising guide post retaining pins to hold the coiled tubing reel skid in position during transport.

19. A coiled tubing transport unit comprising:

a load supporting skid frame having a plurality of guide post sleeves at multiple locations along a length of said skid frame; and a skid frame landing platform having at least one fixed guide post configured to mate with any one of said plurality of guide post sleeves.

20. A method of transporting a coiled tubing unit, the method comprising:

providing a load supporting skid frame having one or more guide post sleeves;

providing a skid frame landing platform having one or more guide posts attachable at multiple locations along a length of a transport unit;

positioning said load supporting skid frame at one of at least two locations along a length of said landing platform, wherein a first location provides a first weight distribution along a length of said platform, and wherein a second location provides a second weight distribution along a length of said platform; and transporting said load supporting skid frame positioned at either of said locations along a length of the landing platform.

* * * * *